United States Patent [19]

Pouchard

[11] Patent Number: 4,686,891

[45] Date of Patent: Aug. 18, 1987

[54] VENTILATING DUCT SYSTEM

[76] Inventor: Fernand Pouchard, 42-09 Broadway, Astoria, N.Y. 11103

[21] Appl. No.: 758,964

[22] Filed: Jul. 25, 1985

[51] Int. Cl.[4] ..... F24F 9/00

[52] U.S. Cl. ..... 98/36; 126/193

[58] Field of Search ..... 98/39.1, 40.18, 40.19, 98/41.3, 36; 126/33, 42, 193

[56] References Cited

U.S. PATENT DOCUMENTS

| | | | |
|---|---|---|---|
| 2,198,419 | 4/1940 | Sutton | 98/36 X |
| 2,497,486 | 2/1950 | Barber | 98/36 |
| 2,500,606 | 3/1950 | Dosmar | 98/36 |
| 3,387,600 | 6/1968 | Terzian | 98/36 |
| 4,108,144 | 8/1978 | Wilhoite | 98/36 X |
| 4,109,563 | 8/1978 | Schleicher | 98/36 X |
| 4,411,252 | 10/1983 | Funkhouser | 98/36 X |
| 4,534,277 | 8/1985 | Gillmor | 98/36 |

FOREIGN PATENT DOCUMENTS

| | | | |
|---|---|---|---|
| 231123 | 5/1963 | Austria | 98/41.3 |

*Primary Examiner*—Harold Joyce

*Attorney, Agent, or Firm*—Stephen E. Feldman

[57] ABSTRACT

A ventilating duct system including a plurality of ducts are disposed about an oven door on the face of an oven. Each duct includes a plurality of spaced openings to allow cool air from a source of cool air to be directed about the oven door. A first air feed duct extends from a distribution box to one corner of the duct system to direct cool air into a pair of ducts that meet and are connected at that corner. A second air feed duct is similarly connected to the other pair of ducts and to the distribution box. An infeed duct directs air to the distribution box. If desired, a control duct can be disposed in each of the ventilating ducts. The control ducts would be connected to the distribution box to receive the cool air therefrom and would be formed with spaced openings and would be movable from a position with its openings aligned with the openings in the ventilating ducts to facilitate the flow of cool air therefrom to positions out of alignment therewith. A damper valve may be disposed in the distribution to control the cool air flow therefrom in response to operation of a thermostat that senses the opening of the oven door. A similar cool air ventilating system may be used with a heated steam table or the like.

8 Claims, 5 Drawing Figures

FIG. 1
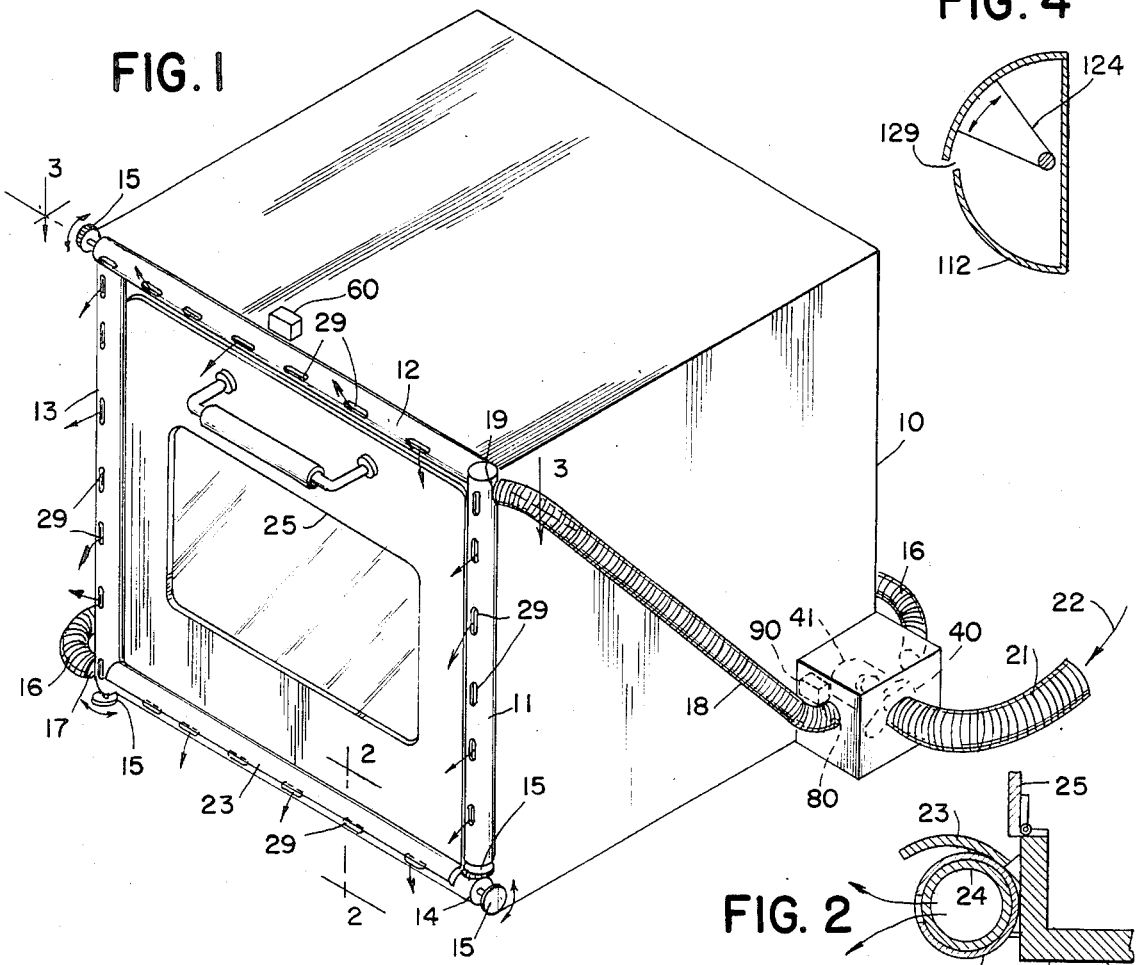
FIG. 4
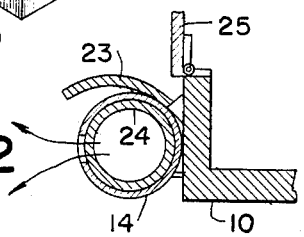
FIG. 2
FIG. 3
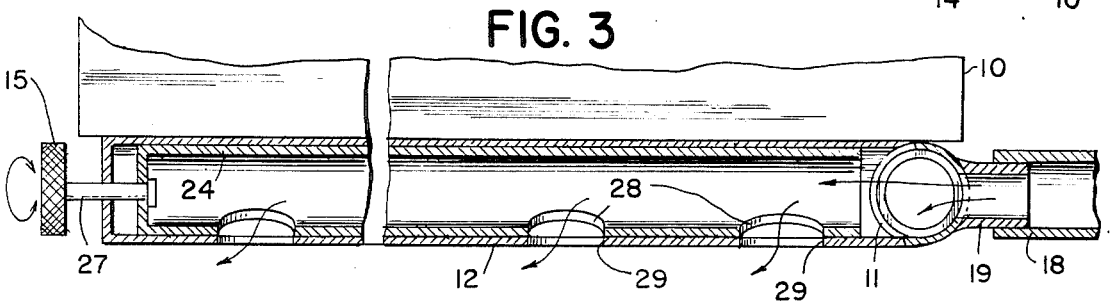
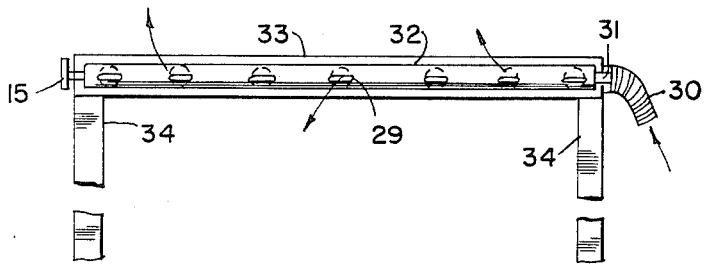
FIG. 5

VENTILATING DUCT SYSTEM

BACKGROUND OF THE INVENTION-FIELD OF APPLICATION

This invention relates to ventilating duct systems; and more particularly, to ventilating duct systems for providing cool air proximate heated appliances and equipment.

BACKGROUND OF THE INVENTION-DESCRIPTION OF THE PRIOR ART

Persons who work in kitchens, bakeries and similar locations where the appliances, equipment and apparatus are heated may experience fatigue from the excess heat given off by such equipment. Exhaust fans provided for such work areas in general do not always afford such persons an adequate relief from the heat.

Similarly, persons who must handle hot trays containing food articles, or who must handle hot cooking utensils, may experience undue heat upon their hands. While gloves, mits and the like are sometimes used about the hands many people cannot work efficiently, or at all, with such hand protection.

Cool air distribution equipment of the type shown in U.S. Pat. No. 4,250,800 granted to H. P. Brockmeyer on Feb. 17, 1981 for Outlet Tube For Air Conditioning Systems, and in U.S. Pat. No. 3,629,999 granted to R. C. Marsh on Dec. 28, 1971 for Clean Air Target Device, are wholly unsuited for application proximate heated cooking and serving equipment. While such equipment of the type shown in U.S. Pat. No. 4,423,669 granted on Jan. 3, 1984 to N. J. Bullock for Air Curtaining Apparatus, and in U.S. Pat. No. 3,387,600 granted on June 11, 1968 to B. A. Tergian for Oven With Automatic Air Curtain Means require a relatively great and costly expenditure of cooled air and utilize relatively complex and costly mechanisms to distribute the cooled air.

SUMMARY OF THE INVENTION

It is therefore an object of this invention to provide a new and improved ventilating duct system for heated equipment.

It is another object of this invention to provide a new and improved ventilating duct system for heated kitchen equipment.

It is yet another object of this invention to provide a new and improved ventilating duct system for directing cooled air proximate heated kitchen equipment.

It is still another object of this invention to provide a new and improved ventilating duct system for controlling the distribution of cooled air proximate heat emitting areas of heated kitchen equipment.

It is yet still a further object of this invention to provide a new and improved thermostatically controlled ventilating duct system for controlling the distribution of cooled air proximate heat emitting locations of heated kitchen equipment.

This invention involves heated kitchen equipment such as ovens, steam tables and the like; and contemplates providing ventilating duct systems therefore for directing cool air proximate the heat emitting locations such as door, tops, and the like of such heated equipment, and providing such ventilating duct systems with control means for decreasing and/or increasing the flow of cool air from such ventilating duct system, or for cutting same off completely.

Other features and advantages of the invention in its details of construction and arrangement of parts will be seen from the above, from the following description of the preferred embodiment when considered with the drawing, and from the appended claims. In addition, these and other objects and advantages of the present invention will become evident from the description which follows.

BRIEF DESCRIPTION OF THE DRAWING

In the drawing:

FIG. 1 is a perspective schematic showing of heated kitchen equipment in the form of an oven, incorporating the instant invention;

FIG. 2 is a cross-section view taken along line 2—2 of FIG. 1;

FIG. 3 is a cross-section view taken along line 3—3 of FIG. 1;

FIG. 4 is a cross-section view of another embodiment of ventilating duct; and FIG. 5 is a schematic elevational view of another piece of heated kitchen equipment, in the form of a heated table, incorporating the instant invention.

DESCRIPTION OF THE PREFERRED EMBODIMENT

With reference to FIG. 1, there is generally shown at 10 a unit of heated kitchen equipment in the form of an oven. Oven 10 includes a housing having a back, top, bottom and sides. A front door 25 is hingedly carried by oven 10 and includes a handle to facilitate opening and closing of door 25 and access into oven 10.

A plurality of vent ducts 11, 12, 13 and 14 are secured to a front lip of oven 10 which surrounds door 25. The securing is accomplished by threaded members such as screws or bolts or may be accomplished by use of adhesive or the like. Each duct 11–14 consists of a hollow, elongated tube having a plurality of oval shaped openings 29 which are approximately equally spaced along a substantially straight line on the circumference of the respective ducts 11–14.

If desired a second hollow cylindrical tube 24 may be coaxially fitted with each duct 11–14 for sliding movement therein to serve as a control vane. Each such tube 24 is secured to a shaft 27 onto which is fitted a cylindrical handle 15. Each tube 24 also includes a plurality of spaced holes disposed therealong to correspond in alignment and positioning with holes 29. As such if handle 15 is rotated, holes 28 of tubes 24 may be moved either into or out of alignment with holes 29 of ducts 11–14. Thus, the passage of air from tubes 24 to and through holes 29 may be readily controlled.

Ducts 11 and 12 are respectively secured along the top and to one side of oven door 25 and are internally connected together at their intersection. An air inlet pipe 19 connects to ducts 11 and 12 at their intersection. A flexible hose 18 has one of its ends fitted to inlet pipe 19 and extends therefrom along the side wall of oven 10 to have its other end fitted and connected to a distribution box 20 located at the back of the oven side wall.

Another flexible coupling 16 is also connected to distribution box 20 and extends therefrom around the back wall of oven 10 to be connected at its other end to an inlet pipe 17. Inlet pipe 17 is interconnected to ducts 13 and 14 at the intersections thereof. These ducts extend along the other side and bottom of oven 10.

An electric fan 40 driven by an electric motor 41 is housed within distribution box 20. Suitable electrical conductors interconnect motor 41 to an appropriate source of electrical power. Appropriate controls are provided for motor 41.

A hose 22 has one of its ends connected to box 20 and the other of its ends connected to a suitable and appropriate source of cool or cooled air.

A semi-circular protective cover 23 (FIG. 2) is provided for and carried by duct 14, which is disposed below oven door 25, so that food particles will not interfere with and block outlets 29 of duct 14.

When a central air conditioning system which provides a source of cool dry air is connected to flexible coupling 21, the cool air will be distributed by fan 40 through flexible coupling 16 and 18 to the internal hollow chambers of ducts 11–14. Cool air traveling through flexible hose 18 will enter inlet 19 and be distributed through ducts 11 and 12. In a similar manner, cool air through coupling 16 will enter inlet 17 and be distributed through ducts 13 and 14. The amount of air conditioning flow which is distributed through outlets 29 can be regulated by rotating handles 15 connected at the ends of each of ducts 11–14, so as to move openings 28 contained in inner cylinder 24 in and out of registration with outlets 29. This will permit the user to regulate the amount of flow of cool air distributed by each of ducts 11–14 so that an even distribution of cool air can be maintained in the vicinity at the front of the oven in spite of the excessive heat which is given off by the oven. Flexible couplings 16 and 18 also aid in the even distribution of cool air applied to inlet coupling 21 to ducts 11–14 so that an even distribution and pressure of cool air can be transmitted from outlets 29.

Alternatively, ducts 12 and 14 could be eliminated so as to reduce the outflow of air. The internal cylinders in those ducts would also be eliminated, and flexible couplings 18 and 16 would supply ducts 11 and 13, respectively. Another alternative would be to eliminate ducts 11 and 13 and have the flexible supply hoses 16 and 18 supply only ducts 12 and 14. It is possible to envision a number of such combinations where one, two or three of the ducts are eliminated, depending upon the application and the required amount of air for that application.

A hose 50 shown attached to the bottom of chamber 20 is another alternative approach that can be used to feed another oven or ovens. The flexible ducts 18, 16 and 15 shown may be supplemented by a multiplicity of ducts feeding a multiplicity of ovens in a manner similar to that described above. Box 20 can thusly supply dry, cool air driven by motor 41 and fan 40, which can be changed in size to accommodate the required flow for the varying sized operations.

A thermostat 60 may be mounted above duct 12 to sense the opening of the door 25 and automatically close a damper valve 80 in chamber 20 by means of an operating solenoid 90 attached to damper valve 80. Individual damper valves 80 and solenoids 90 would be mounted over each flexible inlet duct coming out of the box 20. Although only one is shown, a number of such would correspond to the number of exit hoses such as 16 and 18. These dampers would restrict the flow of air to the hoses and therefore eliminate the flow of air about the oven. Thermostat 60, valve 80 and solenoid 90 are of conventional construction and are installed and connected in a conventional manner.

Holes 29 can be of any size as large as necessary to allow the integrity of the ducts 11 through 14 or as small as may be required to restrict flow, depending upon pressure and flow requirements. Similarly, the holes 28 and internal cylinder 24 may be varied in size to accomplish minimum and maximum air flows corresponding to the requirements of pressure and flow.

FIG. 4 is a cross-sectional view of another construction of ducts 11–14 consisting of a semi-cylindrical tube 112 having a flat back portion 113 and an outlet 129. Tube 112 also includes a shut-off vane 124 which is connected to shaft 27 of handle 15 (not shown) so that vane 124 can control the flow of cool air from outlet 129.

Referring to FIG. 5 there is shown a serving table 33 supported on legs 34 which also includes a similar duct 32 containing a plurality of outlets 29 which communicate to an internal cylinder connected to handle 15. One end of duct 32 also includes an inlet 31 for connection of flexible hose 30. The other end of hose 30 is also connected to a central air conditioning system (not shown) for supplying cool, dry air to the internal cylinder of duct 32. Thus, in a manner similar to that described with respect to the apparatus of FIGS. 1–4, cool dry air is supplied along the periphery serving table 33 so that persons using the table will receive a supply of cool air while handling hot food articles.

As various possible embodiments might be made of the above invention, and as various changes might be made in the embodiment above set forth, it is to be understood that all matter herein described or shown in the accompanying drawing is to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above are presented merely as an example of the invention, coming within the proper scope and spirit of the appended claims, will of course readily suggest themselves to those skilled in the art. Thus, while there has been described what is at present considered to be preferred embodiments of the invention, it will thus be obvious to those skilled in the art that various changes and modifications may be made therein, without departing from the invention, and it is therefore, aimed in the appended claims to cover all such changes and modifications as fall within the true spirit and scope of the invention, and it is understood that, although I have shown the preferred form of my invention, that various modifications may be made in the details thereof, without departing from the spirit as comprehended by the following claims.

What is claimed is:

1. A ventilating system for disposition proximate the oven door of an oven which can be heated for conducting cool air, from a source of cool air thereto; comprising:

(a) first duct means secured proximate the oven door;

(b) openings formed through said first duct means at spaced locations along the length thereof;

(c) second duct means connected to said first duct means and to distribution box means;

(d) third duct means connected to said distribution box means and to the source of cool air such that cool air from the source of cool air is directed to said distribution box means and thereafter from said distribution box means to said second duct means and thence to said first duct means from which the cool air flows out through said openings to cool the area proximate the oven door; and (e) thermostat means disposed for coaction with the oven door and operative in response to opening of the oven door to shut off the flow of cool air from said distribution box means.

2. The ventilating system of claim 1, wherein said first duct means are secured to the oven proximate the oven door so that the cool air is directed thereabout.

3. The ventilating system of claim 2, wherein said first duct means includes at least a first pair of ducts disposed on the face of the oven along two sides thereof.

4. The ventilating system of claim 3, wherein said first pair of ducts are disposed at right angles to each other.

5. The ventilating system of claim 4, wherein said first duct means includes a second pair of ducts connected to the oven face and so as to form with said first pair of ducts a first duct means which surrounds the oven door.

6. The ventilating system of claim 5, including control duct means disposed within said first duct means and movable with respect thereto, said control duct means including spaced openings disposed along the length thereof for alignment with respect to said spaced openings of said first duct means and so as to be movable with movement of said control duct means out of such alignment; said control duct means being connected to said second duct means so that cool air directed thereto passes from said control duct means through said openings in said first duct means when said openings are aligned with said openings in said control duct means.

7. The ventilating system of claim 1, including damper means disposed in said distribution box means to control the movement of cool air therefrom and solenoid means disposed for coaction with said damper means and responsive to operation of said thermostat means.

8. The ventilating system of claim 7, including cover means carried by at least a portion of said first duct means so as to cover but be spaced from said openings therein to prevent particles of matter from entering said first duct means through said openings.

* * * * *